US005084290A

United States Patent [19]

Morita et al.

[11] Patent Number: 5,084,290

[45] Date of Patent: Jan. 28, 1992

[54] METHOD AND APPARATUS FOR APPLYING FRESHNESS KEEPING AGENT TO A FOOD PACKAGING BODY

[75] Inventors: Yoshikazu Morita; Yuichi Fujii, both of Tokyo, Japan

[73] Assignee: Mitsubishi Gas Chemical Co., Inc., Japan

[21] Appl. No.: 551,992

[22] Filed: Jul. 12, 1990

[30] Foreign Application Priority Data

Jul. 14, 1989 [JP] Japan ..... 1-180557

[51] Int. Cl.[5] ..... B65D 81/00; B65B 61/00

[52] U.S. Cl. ..... 426/395; 53/135.3; 53/141; 53/410; 426/118; 426/396; 426/410

[58] Field of Search ..... 426/118, 124, 316, 326, 426/395, 396, 410; 53/135.3, 141, 410, 551

[56] References Cited

U.S. PATENT DOCUMENTS 2,956,612 10/1960 Gaines et al. ..... 156/355
4,332,845 6/1982 Nawata et al. ..... 206/204
4,726,171 2/1988 Kreager et al. ..... 53/410
4,897,273 1/1990 Kotaki et al. ..... 426/410
4,907,393 3/1990 Omori et al. ..... 53/410

FOREIGN PATENT DOCUMENTS 57-6053 1/1982 Japan ..... 426/124

*Primary Examiner*—George Yeung
*Attorney, Agent, or Firm*—Leydig, Voit & Mayer

[57] ABSTRACT

A method and an apparatus for applying a freshness keeping agent to a food packaging body arranged to comprise: a step in which a hot-melt adhesive agent is, at a predetermined interval, dripped on to the inner surface of a wrapping film which is being continuously supplied; a step in which an elongated train consisting of a plurality of freshness keeping agent bags successively connected in a direction and continuously supplied is cut into individual freshness keeping agent bags; a step in which each freshness keeping agent bag is conveyed to the wrapping film through a chute; and a step in which either side of each freshness keeping agent bag and the inner surface of the wrapping film are joined to each other under pressure at a portion to which the hot-melt adhesive agent is applied.

11 Claims, 4 Drawing Sheets

METHOD AND APPARATUS FOR APPLYING FRESHNESS KEEPING AGENT TO A FOOD PACKAGING BODY

BACKGROUND OF THE INVENTION

1. Field of the Invention

The present invention relates to a method and an apparatus for applying a freshness keeping agent bag to a package or container storing food or the like. More particularly, the present invention relates to a method and an apparatus for securing a freshness keeping agent bag to a packaging body for wrapping a food such as confectionery, coffee beans, soybean flour, grain powder, beans, rice, rice cakes, Chinese noodles, ham,sausage and other food products in such a manner that the food is wrapped with the freshness keeping agent bag applied to the inner surface of the wrapping member.

2. Description of the Related Art

Hitherto, a food freshness keeping agent exemplified by an oxygen absorber and a drying agent has been arranged to be in the form of a small bag. A freshness keeping small bag of the type described above (sometimes simply referred to as "freshness keeping agent" hereinafter) has been unfixedly accommodated, together with the subject such as the food to be kept, in the wrapping bag.

Since the conventional freshness keeping agent has not been secured as described above, it may be erroneously identified as a food when opened and it may thereby be erroneously ingested by a consumer. In the case in which it is industrially used, the freshness keeping agent may be supplied together with a packaged food into a food processing machine in the operation of opening the package, which causes a critical problem. For example, in the case of coffee beans or other beans, the freshness keeping agent may be supplied, together with the beans, into a mill, causing the oxygen absorber to be powdered, and what is even worse, the freshness keeping agent may be cooked together with the beans.

Therefore, a method of securing the freshness keeping agent to the package body or wrapping bag has been studied. For example, a method, in which the sealing portion of the freshness keeping agent bag is held in the sealing portion of the wrapping bag, has been proposed. However, a method of the type described above raises a problem in that a stepped portion is undesirably formed in the sealing portion of the wrapping bag. Therefore, sealing pressure cannot be uniformly applied to the sealing portion, causing unsatisfactory sealing strength to be obtained, and airtightness cannot be achieved.

It might be considered feasible to employ a method in which an adhesive is applied to the freshness keeping agent or a hot-melt adhesive is dripped to the surface of the same so as to be directly pasted to the inner surface of the packaging member. Although the above-described method is a simple method, the operation must be completed manually and it cannot be automated.

SUMMARY OF THE INVENTION

Accordingly, an object of the present invention is to enable a freshness keeping agent to be automatically secured to a food packaging or wrapping member in the case where a side pillow wrapping machine, a cup sealer packaging machine or the like is utilized. As a result, problems in that a consumer erroneously ingest the freshness keeping agent or that the freshness keeping agent be mixed with a food at the time of handling the food, can be prevented.

An aspect of the present invention for achieving the above-described object lies in a method of applying a freshness keeping agent to a food packaging body, comprising: a step in which a hot-melt adhesive agent is, at a predetermined interval, dripped on to the inner surface of a wrapping film which is being continuously supplied; a step in which an elongated train consisting of a plurality of freshness keeping agent bags successively connected in a direction and continuously supplied is cut into individual freshness keeping agent bags; a step in which the sole freshness keeping agent bag is conveyed to the wrapping film through a chute; a step in which the sole freshness keeping agent bag and the inner surface of the wrapping film are joined to each other under pressure at a portion to which the hot-melt adhesive agent is applied; and a step in which a food packaging body is formed by wrapping a food by using at least, as a portion, the wrapping film to which the freshness keeping agent bag has been secured.

Another aspect of the present invention lies in an apparatus for applying a freshness keeping agent to a food packaging body, comprising: means for dripping or applying a hot-melt adhesive agent, at a predetermined interval, onto the inner surface of a wrapping film which is being continuously supplied; cutting means for cutting an elongated train consisting of a plurality of freshness keeping agent bags successively connected in a direction and continuously supplied into individual freshness keeping agent bags; chute means for conveying the sole freshness keeping agent bag to the wrapping film; and means for joining, under pressure, the sole freshness keeping agent bag and the inner surface of the wrapping film to each other at a portion to which the hot-melt adhesive agent is applied.

It is preferable that the wrapping film be a film having a gas barrier characteristic (to be sometimes referred to as "gas barrier film" hereinafter). Furthermore, it is preferable that the surface which becomes the inner surface when the wrapped body has been formed be a surface having thermal adhesive property.

The hot-melt adhesive is exemplified by a material, the main component of which is polypropylene or EVA (ethylene-vinyl acetate copolymer). It is preferable that the material with polypropylene be used since it can meet a standard test for food-additive and the like under the food sanitary law and displays a satisfactory high softening temperature and separation resistance.

It is preferable that the interval of dripping the hot-melt adhesive to the wrapping film be the same as the size of one food packaging body (to be sometimes called "one pitch" hereinafter) in the case where one freshness keeping agent bag is applied to one food packaging body.

The elongated train is a belt-like train member consisting of a plurality of freshness keeping agent bags successively connected in at least a direction. Each of the bags is filled with a freshness keeping composition, the bags being separated from each other by heat seal portions. The wrapping material which forms the elongated train for freshness keeping agent bags may be a mono-film, a mono-film sheet, a laminated film or a laminated-film sheet. The heat seal portions forming the boundaries between the bags are to be cut so that individual freshness keeping agent bags are formed.

The shape of the chute is different depending upon the type of the wrapping machine associated with the freshness keeping agent applying apparatus. It is exemplified by a square, a cylinder, an elliptical cylinder, a semi-circular cross sectional cylinder and an oval cylinder. The material thereof is exemplified by plastic, iron and nonferrous metal. The inclination angle of the chute depends upon the size of the freshness keeping agent to be applied. It must be arranged to the degree with which the freshness keeping agent can be quickly and smoothly conveyed. Therefore, it is preferable that the inclination be about 30 to about 60 degrees, further preferably about 40 to about 45 degrees.

Either side of the individual freshness keeping agents, which have been conveyed to the wrapping film through the chute, and the wrapping film, to which the above-described hot-melt adhesive has been applied, are coupled to each other and pressed by a pair of rollers. In this case, it is preferable that the wrapping film and the freshness keeping agent be pressed while being conveyed by the chute and the rollers. It is preferable that the same be further pressed by rollers or the like in order to strongly secure the freshness keeping agent to the wrapping film (the former pressing operation is sometimes referred to as "a temporal pressing" hereinafter).

The wrapping film to which the freshness keeping agent has been applied is conveyed to a food wrapping means in which it accommodates a food so that a food packaging body in which the freshness keeping agent has been applied to the inner surface of the wrapping film is formed. As an example of the food wrapping means, it is preferable that a side pillar wrapping machine or a cup sealer packaging machine be employed.

In a preferred embodiment, the apparatus according to the present invention comprises: means for supplying an elongated train consisting of a plurality of freshness keeping agents and successively and automatically cutting the elongated train into individual freshness keeping agent bags in response to an operation signal supplied from the food wrapping means; means for conveying the individual bags to a predetermined portion via a chute; means for dripping or applying a hot-melt adhesive to a predetermined position on a wrapping film at predetermined intervals in response to a synchronization signal supplied from the food wrapping means; means for supplying each of the thus formed individual freshness keeping agent bags to contact with the hot-melt adhesive on the wrapping film and in response to an operation signal supplied from the wrapping means, temporarily and automatically securing the freshness keeping agent bags to the inner surface of the wrapping film by rollers; and means for further stably securing the freshness keeping agent bags to the wrapping film, by a freshness keeping agent pressing rollers, when desired.

The method of applying the freshness keeping agent to the inner surface of the wrapping film by using the above-exemplified apparatus or a method of forming the food packaging body in which the freshness keeping agent has been applied is exemplified by the following method:

In a predetermined wrapping machine, preferably a side pillow wrapping machine, a cup sealer packaging machine or a multi-bag system, there are provided an automatic freshness keeping agent supplying machine, a hot-melt gun unit for dripping the hot-melt adhesive and a pair of rollers for temporarily applying and pressing the freshness keeping agent onto the wrapping film. First, a portion of a gas-barrier film for forming the food packaging body in the wrapping machine is drawn out through a guide, which includes predetermined rollers disposed outside the wrapping machine. The hot-melt type adhesive is dripped onto a predetermined position on the inner surface of the wrapping film in response to an operation signal supplied from the wrapping machine by using a device such as a hot-melt gun. As an alternative to this, the above-described adhesive may be applied to the same. Then, the wrapping film, to which the hot-melt adhesive has been dripped, is conveyed by a length, which corresponds to the size of one food packaging body, that is, one pitch,in response to an operation signal supplied from the wrapping machine. The above-described operation may be arranged in such a manner that the wrapping film is temporarily stopped after the conveyance for one pitch. However, the above-described stop motion is not necessary, but it may be continuously moved for the purpose of performing the wrapping operation. At the time immediately before the one-pitch conveyance of the above-described wrapping film is made, the elongated train consisting of a plurality of freshness keeping agents successively connected in one direction is cut into individual freshness keeping agents by an automatic freshness keeping agent supplying machine associated with the wrapping machine in response to a synchronizing signal individually supplied from the wrapping machine. Each of the thus formed freshness keeping agents is conveyed through the chute. Then, it is, via the freshness keeping agent temporarily applying roller, allowed to coincide with the hot-melt adhesive dripped on to the wrapping film. As a result, the freshness keeping agent is temporarily pressed onto the wrapping film. Then, the freshness keeping agent is automatically and further stably secured to the inner surface of the wrapping film by the freshness keeping agent pressing roller.

Thus, the freshness keeping agent is secured to a predetermined position on the inner surface of the wrapping film. In the case of the side pillow wrapping machine, a food is then inserted into the wrapping film via a bag forming machine. After it is conveyed by a length for one bag (one pitch), an end sealer is operated so as to seal end portions of each food packaging body, and then the sealed portion is cut. Thus, a food packaging bag is continuously produced. In the case of the cup sealer, the wrapping film, to which the freshness keeping agent has been applied, is introduced into a portion above a cup which has been previously filled with a food. The film with the freshness keeping agent is heat-sealed on the upper surface of the cup at a predetermined position. Then, the cup is conveyed so as to have the film in the periphery of the cup trimmed. As a result, a food packaging cup is completed.

According to the present invention, the following effects can be obtained.

According to the present invention, the freshness keeping agent is applied and secured to a predetermined position of the wrapping member. As a result, the freshness keeping agent is necessarily left in the wrapping bag at the time of drawing out the food from the wrapping bag. Therefore, an erroneous ingestion of the freshness keeping agent or an accidental use of the same at the time of processing the food can be prevented. Furthermore, since the freshness keeping agent is always supplied to a predetermined position via the chute and is applied by the freshness keeping agent temporarily applying roller and the pressing roller, the above-described operation can be stably conducted. As a result, the strength of the application can be improved.

Other and further objects, features and advantages of the invention will be appear more fully from the following

DESCRIPTION OF THE PREFERRED EMBODIMENTS

Figure 1:
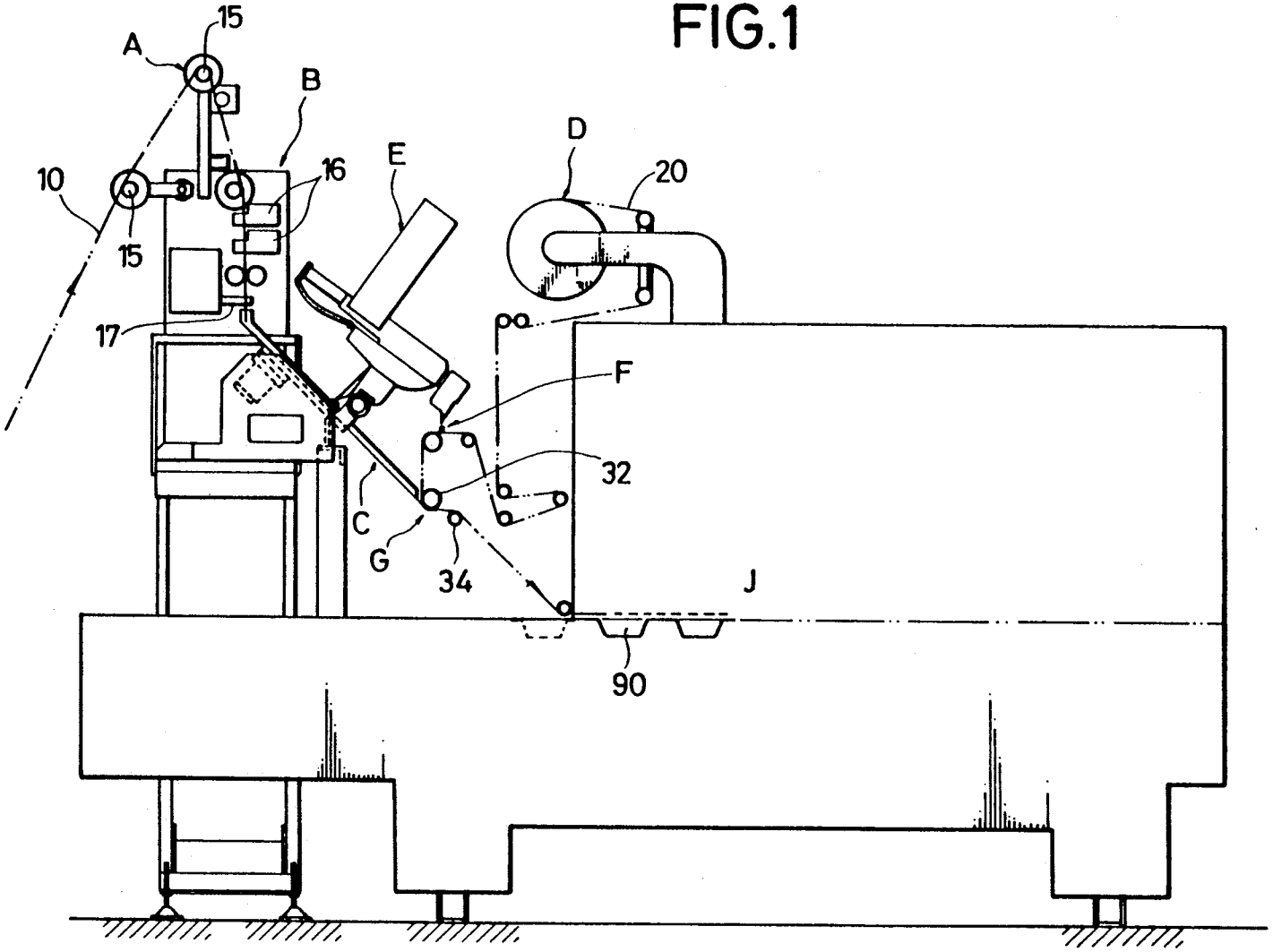
FIG. 1 is a schematic view which illustrates a food wrapping apparatus according to the present invention.

FIG. 1 is a schematic view which illustrates a food wrapping apparatus according to the present invention, wherein a cup sealer packaging machine is used as the wrapping apparatus. The above-described apparatus comprises: elongated train supply means A for automatically supplying an elongated train 10 consisting of a plurality of freshness keeping agents 11 (see FIG. 2); means B for cutting the elongated train 10, which has been supplied from the elongated train supply means A, into individual freshness keeping agents 11; a chute C for conveying the thus formed individual freshness keeping agents 11; wrapping film supply means D for automatically supplying a wrapping film 20,the inner surface of which has thermal adhesive property; hot-melt adhesive agent drip means E for dripping a hot-melt adhesive agent to a predetermined position F of the wrapping film 20; freshness keeping agent securing means G comprising a temporarily applying roller 32 and a pressing roller 34 whereby each of the above-described individual freshness keeping agents and the hot-melt adhesive agent dripped on the predetermined position F of the wrapping film 20 are brought to contact and be pressed with each other in response to an operation signal supplied from a wrapping means J; and means J for conveying the wrapping film 20, to which the freshness keeping agent has been applied, on to a tray 90 so as to heat-seal it by a cup sealer thereof.

Figure 2:
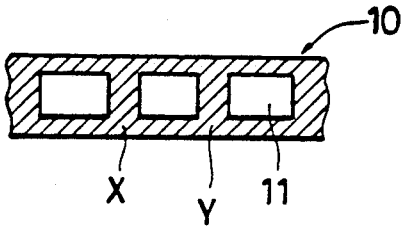
FIG. 2 is a plan view which illustrates an elongated train consisting of a plurality of freshness keeping agents.
Figure 3:
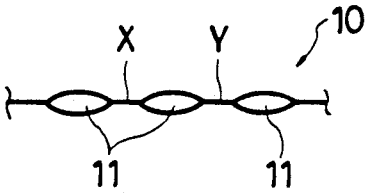
FIG. 3 is a front elevational view of FIG. 2.

As shown in FIGS. 2 and 3, the elongated train supply means A automatically supplies, via a guide roller 15, the elongated train 10 consisting of a plurality of the series freshness keeping agents 11, each of which is separately sealed by sealing portions X and Y. In the means B for automatically cutting the elongated train 10 into individual freshness keeping agents, the heat-sealed portions of the elongated train 10 are detected by a detector 16 and cut into individual freshness keeping agents 11 in the form of a bag by a cutter 17. The thus formed individual freshness keeping agents are successively conveyed by the chute C.

Figure 4:
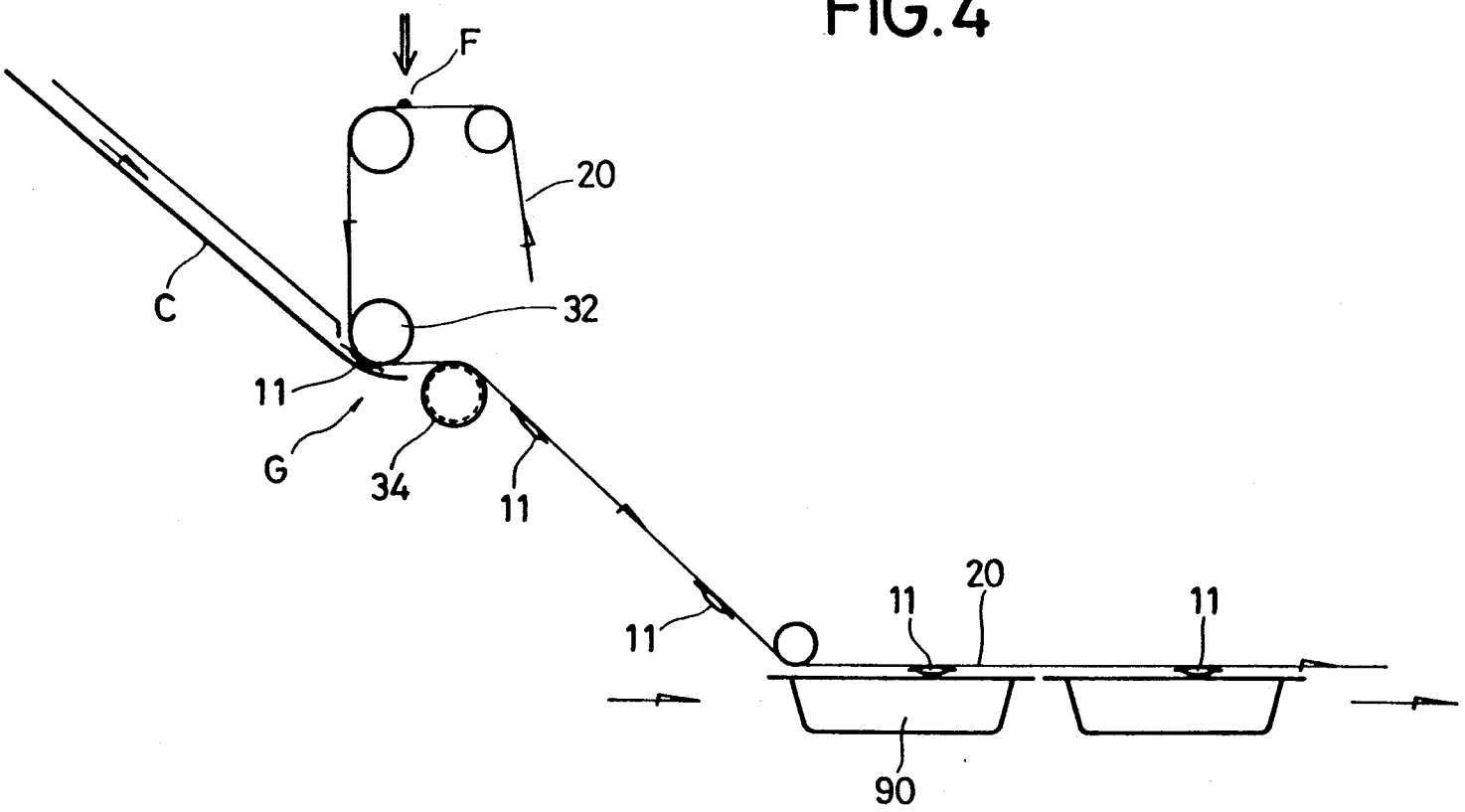
FIG. 4 is a schematic view which illustrates means for cutting the elongated train consisting of the freshness keeping agents into individual freshness keeping agents and allowing the individual agents to coincide with the hot-melt adhesive agent dripped to a predetermined position of the wrapping film so that the freshness keeping agent is secured to the inner surface of the wrapping film.

As shown in FIG. 4, the hot-melt adhesive agent is dripped at predetermined intervals onto the predetermined portion F of the wrapping film 20 in response to the operation signal supplied from the wrapping means or machine J before the wrapping film is conveyed to the cup sealer. The wrapping film 20 is then conveyed in response to a next signal. Immediately before conveying the wrapping film by a length of a single food wrapping body (one pitch) is completed, the freshness keeping agent supply means A associated with the wrapping machine is operated in response to an operation signal supplied from the wrapping machine. As a result, each of the individual freshness keeping agents is, through the chute C, conveyed to the temporarily applying roller 32 of the freshness keeping agent applying means G. Thus, the freshness keeping agent and the hot-melt adhesive agent dripped on to the above-described wrapping film 20 are brought into contact with each other, so that the freshness keeping agent 11 is temporarily applied to the inner surface of the wrapping film 20. In response to a next operation signal, the wrapping film 20 having the freshness keeping agent 11 temporarily secured thereto is conveyed to be further pressed by the next freshness keeping agent pressing roller 34 so that the adhesion strength is stabilized. The wrapping film 20, to which the freshness keeping agent 11 has been securely applied, is then conveyed onto the tray 90 at which it is heat-sealed. The above-described operations are successively and automatically performed.

Figure 5:
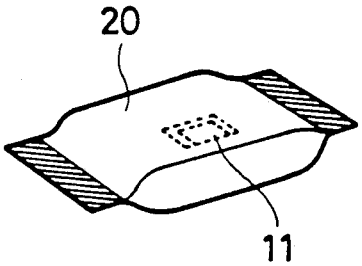
FIG. 5 is a perspective view which illustrates the food wrapping bag formed by a side pillow wrapping machine.
Figure 6:
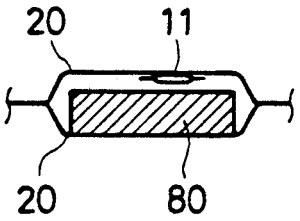
FIG. 6 is a cross sectional view of FIG. 5.
Figure 7:
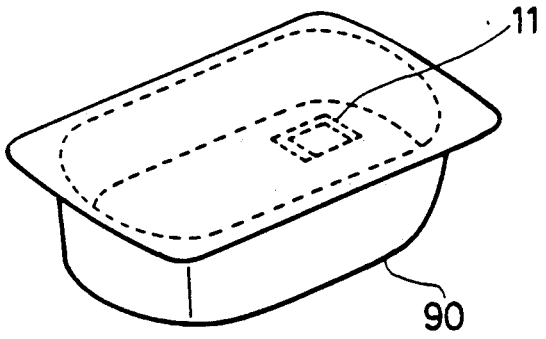
FIG. 7 is a perspective view which illustrates the food packaging cup formed by a cup sealer packaging machine.
Figure 8:
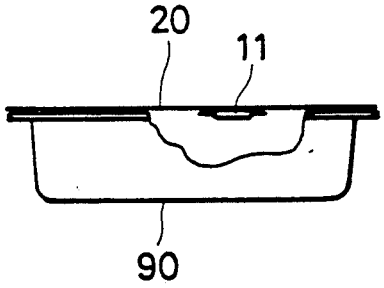
FIG. 8 is a partially cut-away front elevational view of the food packaging cup in FIG. 7.

FIGS. 7 and 8 illustrate the thus formed food packaging body to which the freshness keeping agent 11 has been secured. Although the cup sealer wrapping machine is used as the wrapping machine in the above-described embodiment, a side pillow wrapping machine may be employed. In the side pillow wrapping machine, the above-described freshness keeping agent is similarly secured onto the wrapping film 20, which wraps a food in the pillow-like shape as shown in FIGS. 5 and 6. Referring to FIG. 6, reference numeral 80 represents a food which has been wrapped.

According to the present invention, the freshness keeping agent can be automatically and securely applied to the food packaging body by using a side pillow wrapping machine, a cup sealer packaging machine or the like. Furthermore, the above-described securing operation can be continuously automatically conducted with stably securing the freshness keeping agent to a predetermined position on the inner surface of the wrapping film.

The sheet to which the freshness keeping agent has been secured by the method and apparatus according to the present invention can be preferably used as the food packaging body, since the freshness keeping agent can be easily secured in the wrapping bag manufacturing process. Furthermore, if any portion of the packaging body is opened, the freshness keeping agent is still left in the packaging body. Therefore, problems in that a consumer erroneously ingest the freshness keeping agent or that the freshness keeping agent is erroneously supplied to the food handling operations can be prevented.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A method of applying a freshness-keeping agent to a food packaging body, comprising the steps of:

dripping or applying a hot-melt adhesive agent, at a predetermined interval, onto the inner surface of a wrapping film which is being continuously advanced to a mating portion;

cutting an elongated train consisting of a plurality of freshness-keeping agent bags successively connected in one direction into individual freshness-keeping agent bags;

conveying each of said individual freshness-keeping agent bags to said mating portion through a chute;

joining either side of said freshness-keeping agent bag directly with the inner surface of said wrapping film under pressure at a portion to which said hot-melt adhesive agent has been applied; and forming a food packaging body by wrapping a food by using at least, as a portion, said wrapping film to which said freshness-keeping agent bag has been secured, whereby said food is automatically packaged in said food packaging body using said wrapping film on which said freshness-keeping agent bag is secured.

2. A method according to claim 1, wherein said freshness keeping agent is an oxygen absorber.

3. A method according to claim 1, wherein said wrapping film has a gas barrier characteristic.

4. A method according to claim 1, wherein said hot-melt adhesive agent is a material, the main component of which is polypropylene or an ethylene-vinyl acetate copolymer.

5. A method according to claim 1, wherein said interval for dripping or applying said hot-melt adhesive agent to said wrapping film is substantially the same as the size of one food packaging body in the case where one freshness keeping agent bag is applied to one food packaging body.

6. A method according to claim 1, wherein said freshness keeping agent bag and said wrapping film are first temporarily fixed to each other under pressure at said portion at which said hot-melt adhesive agent is applied and are later secondly fixed to each other under pressure, again.

7. An apparatus for applying a freshness-keeping agent to a food packaging body, comprising:

means for dripping or applying a hot-melt adhesive agent, at a predetermined interval, onto the inner surface of a wrapping film which is being continuously advanced to a mating portion;

cutting means for cutting an elongated train consisting of a plurality of freshness-keeping agent bags successively connected in a direction and continuously supplied into individual freshness-keeping agent bags;

chute means for conveying each of said freshness-keeping agent bags to said mating portion; and means for joining, under pressure, either side of said freshness-keeping agent bag directly with the inner surface of said wrapping film to each other at a portion to which said hot-melt adhesive agent has been applied.

8. An apparatus according to claim 7, wherein said freshness keeping agent is an oxygen absorber.

9. An apparatus according to claim 7, wherein said wrapping film has a gas barrier characteristic.

10. An apparatus according to claim 7, wherein said hot-melt adhesive agent is a material, the main component of which is polypropylene or an ethylene-vinyl acetate copolymer 11. An apparatus according to claim 7, wherein said joining means comprises rollers.

* * * * *